US009663320B2

(12) United States Patent
Wittmann et al.

(10) Patent No.: US 9,663,320 B2
(45) Date of Patent: May 30, 2017

(54) METHOD AND MACHINE FOR FORMING BAG PACKS

(71) Applicant: HOLWEG GROUP, Molsheim (FR)

(72) Inventors: Eric Wittmann, Neuwiller les Saverne (FR); Hervé Olry, Saulcy sur Meurthe (FR); Cédric Ritondo, Eschau (FR)

(73) Assignee: HOLWEG GROUP, Molsheim (FR)

( * ) Notice: Subject to any disclaimer, the term of this patent is extended or adjusted under 35 U.S.C. 154(b) by 80 days.

(21) Appl. No.: 14/398,539

(22) PCT Filed: May 2, 2013

(86) PCT No.: PCT/FR2013/050962
§ 371 (c)(1),
(2) Date: Nov. 3, 2014

(87) PCT Pub. No.: WO2013/164543
PCT Pub. Date: Nov. 7, 2013

(65) Prior Publication Data

US 2015/0118004 A1 Apr. 30, 2015

(30) Foreign Application Priority Data

May 3, 2012 (FR) ..... 12 54075

(51) Int. Cl.
*B65H 29/34* (2006.01)
*B65H 29/26* (2006.01)
(Continued)

(52) U.S. Cl.
CPC ..... *B65H 31/10* (2013.01); *B65H 29/6627* (2013.01); *B65H 31/30* (2013.01);
(Continued)

(58) Field of Classification Search
CPC ..... B65H 2220/02; B65H 2220/09; B65H 31/32; B65H 2405/32; B65H 2511/22;
(Continued)

(56) References Cited

U.S. PATENT DOCUMENTS 2,606,483 A * 8/1952 Forbes, Jr. ..... B65G 57/11 414/789.1
3,054,516 A * 9/1962 Joa ..... B65H 29/34 414/790
(Continued)

FOREIGN PATENT DOCUMENTS

DE 20 2004 005 723 U1 8/2005
JP S 63-82278 4/1988
(Continued)

OTHER PUBLICATIONS

PCT/FR2013/050962 International Search Report dated Aug. 26, 2013 (4 pages including English translation).

*Primary Examiner* — Gregory Adams
(74) *Attorney, Agent, or Firm* — Brinks Gilson & Lione; G. Peter Nichols

(57) ABSTRACT

According to a method for forming packs of flat bags, a continuous line of bags moving in an oriented direction of advance is received. The bags are moved onto a receiving table on which the bags are stacked while being stopped from moving in the oriented direction of advance by an abutment. The continuous line of bags is converted into a line of overlapped bags before stacking the latter, and the bags are separated on the receiving table by separating means comprising a separating device. During this operation, a separating device is inserted by a movement in the separating direction perpendicular to the plane of the bags between a preceding bag and a following bag in the overlapped line in such a way that, when the following bag stops
(Continued)

against the abutment, it is supported at least partially by the separating means.

17 Claims, 5 Drawing Sheets

(51) Int. Cl.
*B65H 31/10* (2006.01)
*B65H 29/66* (2006.01)
*B65H 31/32* (2006.01)
*B65H 33/00* (2006.01)
*B65H 31/30* (2006.01)

(52) U.S. Cl.
CPC ..... *B65H 31/32* (2013.01); *B65H 33/00* (2013.01); *B31B 2219/922* (2013.01); *B31B 2219/925* (2013.01); *B65H 2301/42622* (2013.01); *B65H 2701/191* (2013.01)

(58) Field of Classification Search
CPC ..... B65H 29/66; B65H 33/12; B65H 2301/422615; B65H 2301/42622; B65H 2701/1932; B65H 29/68; B65H 29/6627; B65H 33/00; B65H 2701/191; B31B 1/00; B31B 2219/922; B31B 2219/925
USPC ..... 101/240; 271/182, 202, 218; 414/790, 414/790.1, 790.4, 790.8, 790.9, 792.7, 414/793.6, 794.4, 794.5; 83/110
See application file for complete search history.

(56) References Cited

U.S. PATENT DOCUMENTS 3,565,423 A * 2/1971 Kluth ..... B65H 29/60 271/199
3,643,940 A * 2/1972 Lopez ..... B65H 29/66 198/579
3,683,758 A * 8/1972 Feldkamper ..... B65H 29/66 271/3.01
3,724,840 A * 4/1973 Kuckhermann ... B65H 29/6654 271/182
3,911,800 A * 10/1975 Feldkamper ..... B65H 29/18 198/462.2
3,938,674 A * 2/1976 Kroeze ..... B65H 29/18 271/201
4,010,945 A * 3/1977 Kistner ..... B65H 5/24 271/151
4,249,844 A * 2/1981 Lampe ..... B65H 29/34 271/189
4,364,552 A * 12/1982 Besemann ..... B65H 29/6627 271/182
4,526,362 A * 7/1985 Thierstein ..... B65H 29/006 242/528
4,586,315 A * 5/1986 Wolf ..... A61L 27/227 53/245
4,903,908 A * 2/1990 Hansch ..... B65H 5/28 242/528
4,934,687 A * 6/1990 Hayden ..... B65H 9/04 198/461.3
5,039,082 A * 8/1991 Littleton ..... B65H 29/58 271/182
5,074,743 A * 12/1991 Schaffner ..... B65H 31/32 271/218
5,190,281 A * 3/1993 Cardenas ..... B65H 29/66 271/198
5,265,861 A 11/1993 Schaffner et al.
5,322,272 A * 6/1994 Benz ..... B65H 31/32 271/211
5,346,206 A * 9/1994 Steinhart ..... B65H 29/60 271/182
5,370,382 A * 12/1994 Wetter ..... B65H 31/3018 271/183
5,435,541 A * 7/1995 Fornay ..... B23D 33/025 271/189
5,536,001 A * 7/1996 Lange ..... B65H 29/12 198/462.3
5,769,413 A * 6/1998 Hummel ..... B65H 31/3018 271/213
5,868,549 A * 2/1999 Lee ..... B65G 57/245 414/676
6,398,010 B1 * 6/2002 Fangmeier ..... B65H 29/68 198/460.3
6,497,549 B2 * 12/2002 Brown ..... B65H 31/10 414/789.9
6,669,193 B2 * 12/2003 Lovaghy ..... B65H 29/6609 198/459.5
7,651,089 B2 * 1/2010 Hopner ..... B65H 31/32 271/218
8,002,513 B2 * 8/2011 Malenke ..... B65G 43/08 414/790.5
2010/0276249 A1 * 11/2010 Kalm ..... B43M 3/045 198/418.9
2011/0224820 A1 * 9/2011 Gammerler ..... B65G 57/11 700/218

FOREIGN PATENT DOCUMENTS

JP 2001130513 A * 5/2001
WO WO 91/08974 6/1991

* cited by examiner

METHOD AND MACHINE FOR FORMING BAG PACKS

This application claims priority to International Application No. PCT/FR2013/050962 filed May 2, 2013 and French Patent Appln. No. 1254075 filed May 3, 2012; the entire contents of each are incorporated herein by reference.

BACKGROUND

The invention relates to a method for forming packs of flat bags, in particular flexible and long bags, continuously leaving a production line of the said bags. It concerns a machine carrying out such a method.

SUMMARY

A certain type of bag is made of a flexible material such as paper, plastic film or a combination of the two and is intended in particular for the packaging of food products such as bread or bulk products. The format of the bag is adapted to its use in such a way that certain bags have a long and narrow shape. This is the case, for example, of bags intended for the packaging of bread baguettes.

These bags are produced on a production line which starts with a rolled sheet, then forms a bead which is flattened, cut and closed at one end by a glued flap. In certain cases, a flap is also formed at the end opposite to the one which is closed. The bag leaves this line flat on a conveyor belt, the flap being located towards the front and protruding from the conveyor belt as shown on FIG. 3.

In certain configurations, the bag is driven vertically to a receiving table on which a stack of bags forms. The stack pushes on a square which maintains an end of the stack. Document DE 20 2004 005723 U1 shows such a configuration. Such an arrangement gives satisfaction when the speed at which the bags arrive is not too high and when the bags have a good intrinsic strength which comes from the basis weight of the film and the dimensional ratios. This is not the case for bags with a long shape. These bags have a strength which is not sufficient to stay upright against the square.

A stack forming machine comprising a conveyor extending horizontally above a receiving table is also known. The conveyor grips a front edge of a bag which arrives by pinching it and brings it above the receiving table to release it when the bag is completely above the receiving table. The bag is then stopped by an abutment in the movement axis of the bags. Such a machine is limited in speed by the fact that, above a certain speed, the bags distort and are damaged when they arrive against the abutment.

Document WO 91/08974 A1 shows a cardboard sheet cutting and stacking machine. After cutting, the sheets are accelerated to move on the table in a separate manner. Overlapping forming means allow the sheets to be slowed down and arranged in an overlapped manner. All of the sheets then move at reduced speed. The sheets are then transported by transport means to a receiving table. The sheets arrive in abutment against a cleat and are stacked on the receiving table.

When the stack is complete, the machine must be stopped to remove the stack of sheets or to evacuate the receiving table with the stack and replace the table with a new table. Such an installation is not appropriate for the production of bags due to the fact that certain bags produced in the transitory stop and restart phases which are imposed for the evacuation of the stack may not be in compliance with the quality requirements and must be downgraded.

The aim of the invention is to provide a method and a machine to form packs of bags, in particular long bags, at high rate and without interruption in the production of the bags during the evacuation of the packs.

With these targets in mind, the object of the invention is a method for forming packs of flat bags wherein a continuous line of bags moving in an oriented direction of advance is received, the bags are moved onto a receiving table on which the bags are stacked being stopped from moving in the oriented direction of advance by an abutment, characterised in that the continuous line of bags is transformed into a line of overlapped bags before stacking the latter, and the bags are separated on the receiving table by separating means comprising a separating device. During this operation, the separating device is inserted, by a movement in a separating direction perpendicular to the plane of the bags, between a preceding bag and a following bag in the overlapped line such that, when the following bag is stopped against the abutment, it is at least partially supported by the separating means.

Means are thus provided to retain on the receiving table the bags which continue to be produced while the bags stacked up to the preceding bag are evacuated. The overlapping of the bags allows a high reduction in the movement speed of the bags to be obtained. The separating device, by being inserted via the top of the line of bags, can be put into place very rapidly, without risking collision with a moving bag, the speed of which has already been reduced. The bags which continue to be produced are stored above the following bag which is retained and there is no need to interrupt their production. This allows permanent conditions to be guaranteed for the production of the bags and allows the dispersion of the characteristic properties of the bags to be limited. The separating device can be operated automatically, for example, after the passage of a predetermined number of bags since the start of the production or the previous bag evacuation operation. The packs thus formed are formatted in a reproducible and parameterisable manner. Also, as the movement speed of the bags has been reduced by the overlapping, it no longer comprises a limit for the bag production rate. High rates can therefore be reached whilst forming packs simple to handle.

In a particular manner, the following bag and the preceding bag are separated at least at the rear edges of the bags and, the separating means comprising a separating table, the separating table is inserted in the oriented direction of advance between the preceding bag and the following bag to support the following bag. The separating table supports the following bag and those which are stacked above in a very dependable manner. The insertion of the separating table can be done even if the following bag still partially bears against the preceding bag. The installation is easily adapted to bags of different lengths by simply modifying the travel of the separating table.

According to a first embodiment, the separating device is inserted up to a first level and until the preceding bag is in abutment, then the separating device is moved up to a second level maintaining the rear edge of the following bag by a flexible blade protruding in the oriented direction of advance to separate the following bag and the preceding bag at the rear edges. At the first level, the separating device maintains the conditions allowing the preceding bag to reach the abutment, therefore avoiding the exertion of a pressure on the said bag. The combination of the flexible blade and of the separating device then allows the separation of the bags to be obtained, at least at the rear edge, when the device forces the rear edges of the bags under the preceding bag to pass over the flexible blade, whereas the following bag is retained after passing the separating device. A space is thus created in which the separating table can be inserted. The first and second levels can represent a position or a force. The force has the advantage of being able to follow the continuous stacking of the bags. The position has the advantage of being simpler to control.

According to a second embodiment, also using the separating table, the following bag is separated from the preceding bag by lowering the receiving table, the separating device supporting the rear edge of at least the following bag. In this configuration, the space is created by lowering the receiving table which supports the bag pack surmounted by the preceding bag. The separating table can then be inserted to support the bags over their complete length.

According to an additional step, after the insertion of the separating table, the separating device is then retracted. The following bag and the bags which follow are thus accommodated by the separating table whilst the separating device can return to its place, waiting to separate the next pack. The retraction is for example a movement perpendicular to the oriented direction of advance and to the separating movement. The separating device is thus freed so that it can return to a position in which the device is ready to restart a cycle.

According to a third embodiment, the following bag is supported by the separating device essentially along the complete length of the bag and the receiving table is lowered, the separating device supporting the following bag. In this case, there is no separating table, the support of the bags being ensured only by the separating device. The advantage of this embodiment is that it requires fewer components; however the separating device must be calibrated to receive and support the following bag over the major part of its length. It must be possible to adapt the following bag support parts to the length of the bags. This can be done by providing different sets of support parts.

According to an improvement, the position of the continuous separating device is adjusted to maintain the upper level of the stack of bags on the following bag at a constant level. Thus the same bag receiving conditions are maintained as and when the bag pack is made up, when it is supported by the separating device.

Also, the position of the receiving table is continuously adjusted to maintain the upper level of the stack of bags at a constant level. This applies when the receiving table supports a bag pack onto which new bags are stacked.

According to an improvement, the upper level of the stack is maintained against upper transport means placed above the receiving table and accommodating the bags arriving on the stack in the oriented direction of advance up to the abutment. The upper transport means help the bags in the upper part of the stack to reach the abutment, particularly when the upper level of the stack is maintained constant by the movement of the receiving table which also maintains a light pressure between the stack and the upper transport means.

In a complementary step, after the following bag is supported, the receiving table is moved down, the bag pack supported by the receiving table is evacuated, the receiving table is moved up and the separating means are retracted to transfer the following bag to the receiving table. Thus a return is made to a position similar to the one at the start of the cycle. The formed pack can then be dealt with in various ways, by being taken manually to be packaged, by being strapped in a manual or automatic manner, or being palletized in an automated manner.

In a particular manner, the separating device is moved according to a square cycle in a plane perpendicular to the oriented direction of advance, one of the movements of the square cycle being the insertion of the separating device. Such a movement can easily be implemented by the association of two translation guide systems. The square cycle must be understood as a succession of translation steps and not as the trajectory really described by the separating device. The trajectory is more or less rectangular but could also be a parallelogram.

According to a constructive arrangement, the first transfer means move at a speed lower than the arrival speed of the bags at a distance from each other, a press down member upstream of the first transfer means moves the rear edge of a first bag in a press down direction perpendicular to the plane of the bags until a second bag which follows the first bag overlaps onto the rear edge of the first bag. By thus making a stack of overlapped bags, the speed of the said bags is reduced to a great extent, so that they can be handled later more easily. The use of a press down member is one of the possible means to obtain this overlapping.

According to an improvement, a brake near to and downstream of the press down member places the first bag against the first transfer means near to the rear edge of the said first bag. By slowing down the bag upstream, the bag is not submitted to axial compression which could cause the bag to buckle.

According to an additional improvement, the overlapped bags are placed against the first transfer means by a roller, the bag passing under the roller after it has been braked by the brake. Thus it is ensured that the overlapped bags are driven by the first transfer means.

In the case where each bag includes a folded unstuck flap to be pressed down onto the first face of the bag, the bags are placed so that they reach the first transfer means with the flap forwards and the first face oriented in the press down direction. The flap is thus maintained against the preceding bag and there is no risk of it being caught on another bag, even by sliding on the previous bag during the stacking.

The object of the invention is also a machine for forming packs of bags receiving a continuous line of bags moving in an oriented direction of advance, a receiving table on which the bags are stacked being stopped by an abutment, the machine being characterised in that it includes braking means to receive the continuous line of bags and form a line of overlapped bags on the first transfer means, the separating means receiving the line of overlapped bags from the first transfer means and comprising a separating device sliding according to a movement perpendicular to the bag plane between a retracted position and a separation position to be inserted between a preceding bag and a following bag in separation position in such a way that, when the following bag stops against the abutment, it is supported by the separating means and in that the machine uses the method as described above.

In a particular configuration, the machine comprises means for turning over bags with flaps, the turnover means including a pair of turnover transport means delimiting between them a trajectory describing approximately a U-turn. Certain bag production machines supply a line of bags where the first face, onto which the flaps are intended to be pressed down, is oriented upwards. They must then be turned over so that the first face will be placed opposite the first transfer means.

BRIEF DESCRIPTION OF THE DRAWINGS

The invention will be better understood and other features and advantages of the invention will become apparent on reading the following description, the description making reference to the appended drawings where.

DETAILED DESCRIPTION

In the description which follows, the top and the bottom refer to the orientations in the normal position of the machine. The front edge of the bag is the one which arrives first in the bag movement direction, the rear edge being opposite to the front edge.

Figure 1:
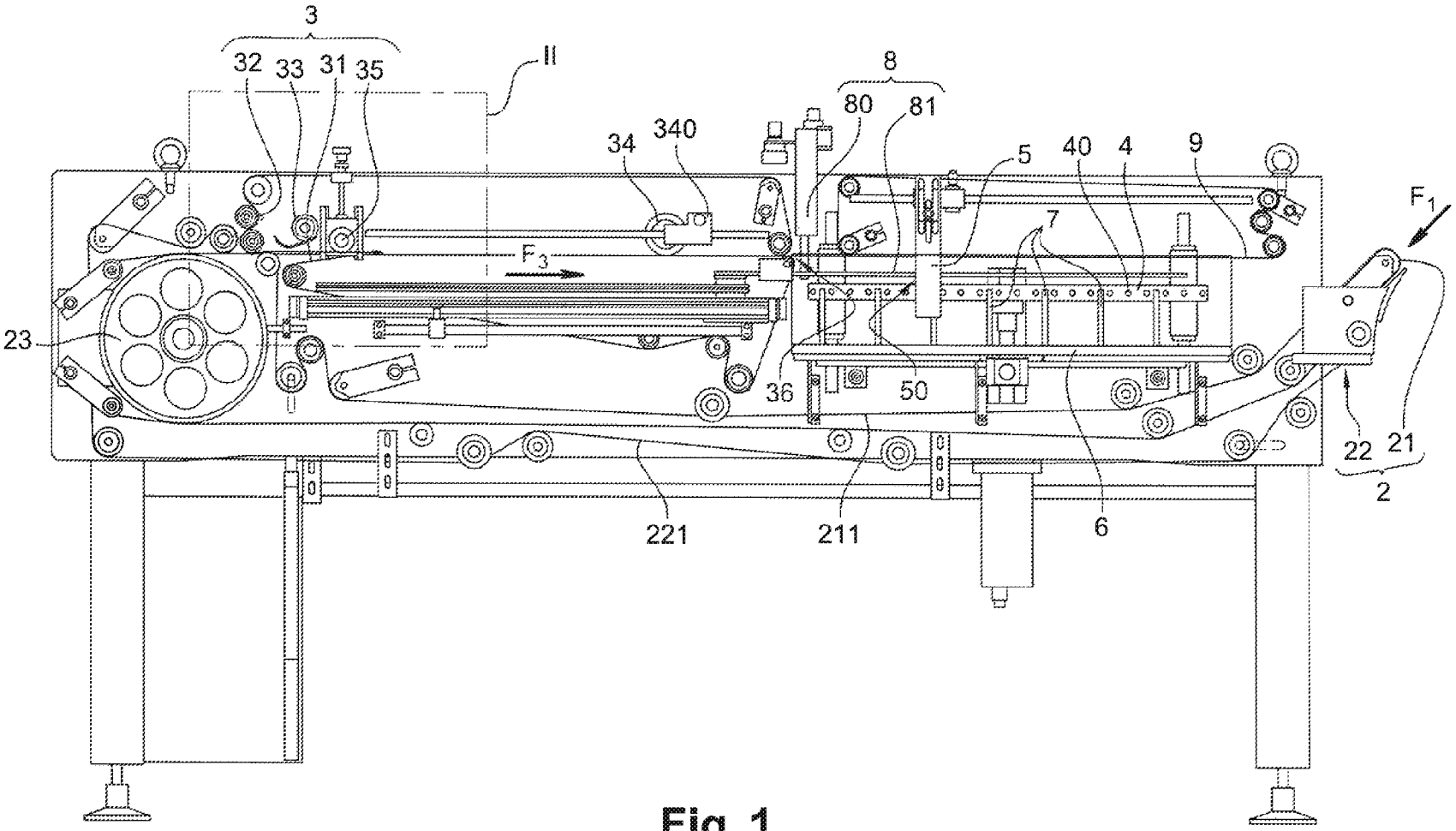
FIG. 1 is a side view of a machine in compliance with an embodiment of the invention.
Figure 2:
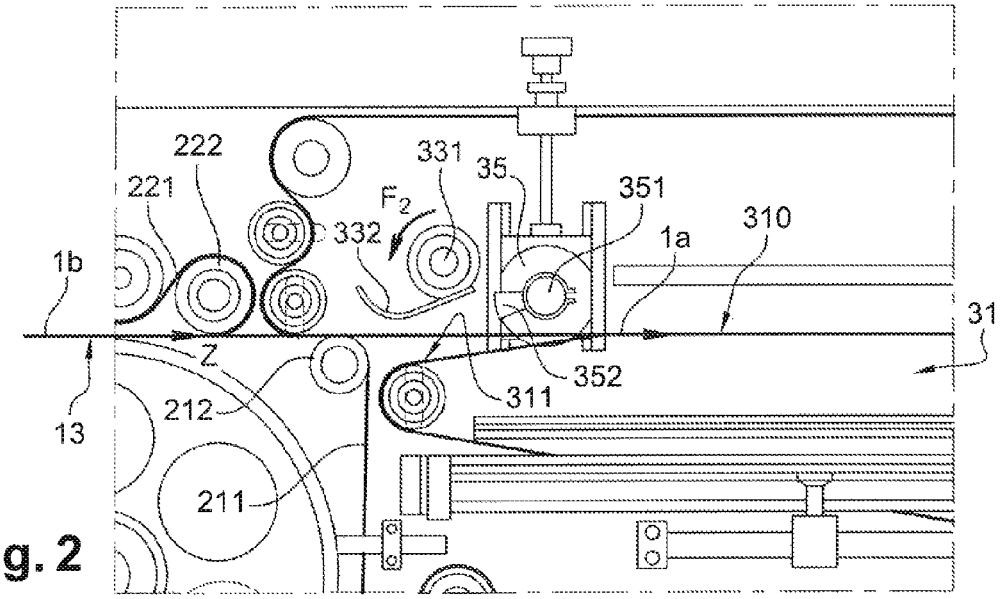
FIG. 2 is a detailed view II of FIG. 1.
Figure 3:
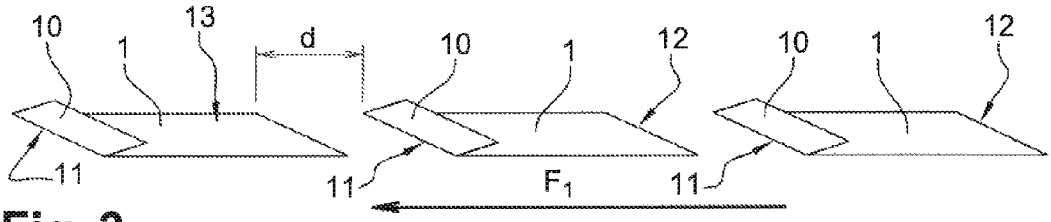
FIG. 3 is a schematic view of the arrangement of the bags from a said bag production machine.

A machine for forming packs of bags, in compliance with a first embodiment of the invention and shown on FIGS. 1 and 2, is intended to receive bags 1 from a bag production machine, not shown, at output of which the bags 1 are delivered one by one, flat in a continuous line, the bags 1 being separated from each other by a small interval d, as shown on FIG. 3. The continuous line arrives at the pack forming machine along a path symbolized by arrow F1 on FIG. 1. The bags 1 comprise, for example, a flap 10 along a front edge 11 which arrives first in the feed direction of the line of bags 1. The flap 10 is pressed onto a first face 13 of the bag without being glued, the flap being oriented upwards on leaving the production machine. The pack forming machine comprises turnover means 2 to place the bags 1 with the first face 13 oriented downwards, braking means 3 to receive the continuous line of turned over bags 1 and to form a line of overlapped bags 1 moving in an oriented direction of advance F3 on the first transfer means 31, and a receiving table 4 on which the overlapped bags 1 from the first transfer means 31 are stacked being stopped by an abutment 5.

The turnover means 2 comprise a pair of turnover transport means 21, 22 delimiting between them a turnover trajectory describing approximately a U-turn. This turnover trajectory extends from one end of the pack forming machine to the other passing via the lower part of the machine then pressing against a wheel 23 which makes the U-turn, represented on the LH part of FIG. 1, to finish in an advance direction substantially horizontal, from the left to the right on FIG. 1. The turnover transport means 21, 22 comprise in a conventional manner one or more conveyor belts parallel to each other, in loop form, guided by rollers rotationally mounted some of which ensure the drive, in a manner not detailed here. For description simplification reasons only, it is considered that each element of the pair of transport means comprises only one conveyor belt. The belts of the first and second turnover transport means 21, 22 of the pair are opposite each other on the turnover trajectory of the bags 1, in order to grip them, then respectively follow a first and a second return trajectory 211, 221.

Referring to FIG. 2, the first turnover transport means 21 comprise a first roller 212 which guides the first conveyor belt and orientates it towards the first return path 211. The first roller 212 is placed to the substantially tangent to a horizontal plane tangent to the wheel 23, the first return trajectory 211 being oriented at this level downwards. Moreover, the second turnover transport means 22 comprise a second roller 222 which guides the second conveyor belt and orientates it towards the second return trajectory 221. The second roller 222 is placed in a manner substantially tangent to the horizontal plane tangent to the wheel 23, the second return trajectory 221 being oriented at this level upwards. The second roller 222 is nearer to the wheel 23 than the first roller 212 to leave free a transfer zone Z above the first conveyor belt.

The braking means 3 comprise the first transfer means 31, the second transfer means 32, a press down member 33 and a stop roller 34. The first transfer means 31 comprise a conveyor belt a part of which extends presenting a face 310 oriented upwards in the continuity plane of the turnover transport means 2. The conveyor belt also has a ramp 311, rising in the oriented direction of advance F3, just after the first roller 212. The press down member 33 is placed opposite this ramp 311. The press down member 33 comprises a shaft 331 rotationally mounted along a transversal axis in the direction shown by arrow F2, that is in a direction accompanying the movement of the bags 1 in the oriented direction of advance F3. The shaft of the press down member 33 also comprises blades 332 curved upstream, that is in the direction opposite to arrow F2. The trajectory of the blades 332 extends in the zone included between the ramp 311 and the trajectory of the bags 1 in the oriented direction of advance F3.

The second transfer means 32 have a part which extends above the transfer zone Z and in the direction of advance above the first transfer means 31. They comprise several conveyor belts leaving passages between them for the blades 332 of the press down member 33. The brake 35 is located in the vicinity and downstream of the press down member 33, opposite the end of the ramp 311. It also comprises a rotationally mounted shaft 351 and a cam 352 protruding from the shaft. The brake 35 and the press down member 33 comprise drive means, not shown, which drive it in a synchronous manner.

The roller 34 is freely rotationally mounted around an axle also transversal. Its support 340 is movably mounted in translation to be placed at an adjustable distance in relation to the press down member 33. The roller 34 remains in contact in the direction of the first transfer means 31.

The first and second transfer means 31, 32 separate at the level of a nose 36 above the receiving table 4. The receiving table 4 can be flat but, here, it comprises a set of bars 40 placed parallel to each other in a plane substantially horizontal and in a transverse direction. The receiving table 4 is vertically slidingly mounted. The machine also comprises a transfer table 6, parallel to the receiving table 4, to receive the formed packs and supported by the receiving table 4. The transfer table 6 comprises slots in which the bars are housed when the receiving table 4 is in its lowest position. The machine also comprises a mobile ejection grid 7 in a transverse direction to make the formed and deposited pack slide on the transfer table 6 to a transverse position where it can be picked up, manually or by means not detailed here.

The machine also comprises separating means 8 including a separating device 80 and a separating table 81. The separating device 80 is placed just downstream and above the nose 36, at the outlet of the transfer means 31, 32. It comprises two subassemblies, each subassembly comprising a finger 801 extending transversally, as shown in particular on FIG. 7. The separating device 80 is translationally mobile in a vertical direction, between a retraction position and a separation position, each finger 801 being transversally mobile to move away from or towards each other in a synchronous manner.

Figure 5:
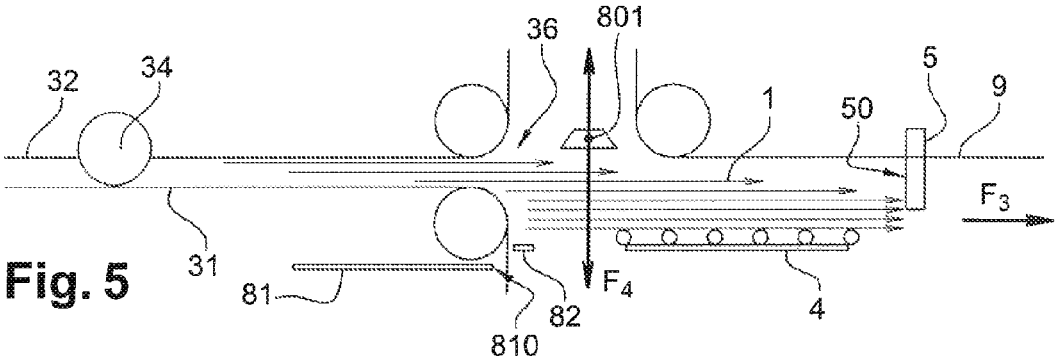
FIGS. 5 and 6 are schematic side views of the stack of bags in particular phases of the method according to the invention.
Figure 6:
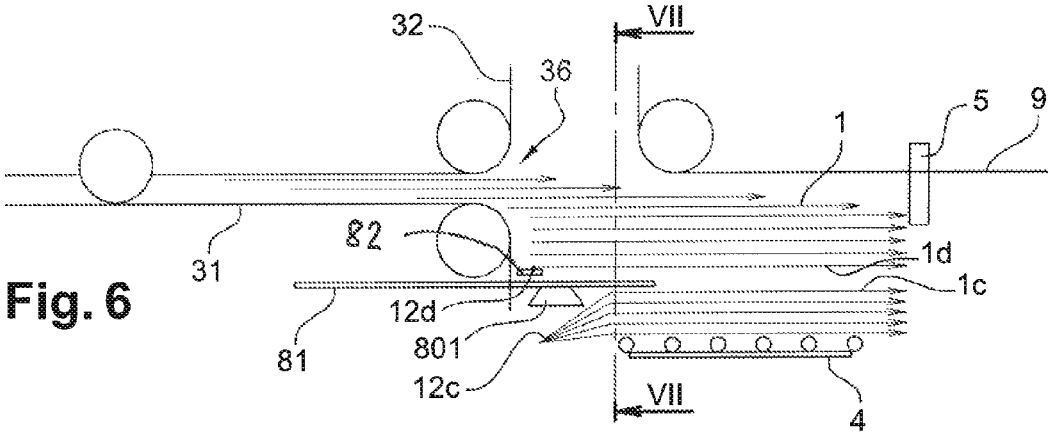

The separating table 81 is mounted translationally mobile in the advance direction between a retraction position, as shown on FIG. 5, and a support position, as shown on FIGS. 1 and 6. In retraction position, the separating table 81 is housed under the first transfer means 31, a front part 810 of the table being set back from the nose 36 in relation to the oriented direction of advance F3. In support position, the separating table 81 extends above the receiving table 4, after sliding in the oriented direction of advance F3.

The separating means 8 also comprise a flexible blade 82 extending horizontally under the nose 36 and above the plane of the separating table 81 and protruding in the advance direction.

The pack forming machine also comprises an abutment 5 to stop the bags 1 above the receiving table 4. The abutment 5 has an abutment face 50 extending vertically with regard to the nose 36. Its position is adjustable to adjust the distance between the nose 36 and the abutment face 50 according to the length of the bags 1 to be stacked.

The pack forming machine also comprises upper transport means 9 placed above the receiving table 4. They have a horizontal face oriented downwards and intended by its movement to accompany up to the abutment 5 the bags 1 arriving on the stack in the oriented direction of advance F3. The upper transport means 9 comprise for example two looped belts 90.

The line of bags 1 from the production machine arrive in the direction of arrow F1 in such a way that the bags 1 are handled individually by the turnover transport means 21, 22, between the conveyor belts. The bags 1 follow the turnover trajectory and arrive in the transfer zone, the first face 13 being oriented downwards.

The transfer means 31, 32 are driven at a speed much lower than the turnover transport means 21, 22. Typically, the linear speed ratio is 10 to 1. This ratio is ensured either mechanically by coupling the respective drive means, or by a differentiated control of electric motors.

Figure 4:
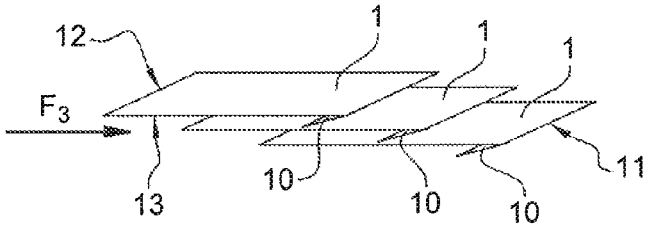
FIG. 4 is a schematic view of the overlapped bags.

A first bag 1*a* which arrives from the turnover transport means 21, 22 remains substantially at the same speed whilst its rear edge has not left the transfer zone. When the rear edge 12 is above the ramp 311, the blades 332 of the press down member 33 push the said edge 12 downwards, in a press down direction perpendicular to the plane of the bags 1. The first bag 1*a* begins to slow down, due to the fact that it is in contact with the first transfer means 31. A second bag 1*b*, following the first bag 1*a*, then covers the rear edge 12 of the first bag 1*a* by sliding into the curved part of the blades 332. The press down member 33 retracts continuing its rotation in the direction of arrow F2. The brake 35, by turning in the same direction, presses on the first bag 1*a* to place it against the first transfer means 31 in the vicinity of the rear edge 12 of the said first bag 1*a*. It is then at the same speed as the first transfer means 31 remaining tensioned during the braking operation. The second bag 1*b* can continue to advance rapidly thus overlapping onto the first bag 1*a*, as shown on FIG. 4. The press down member 33 and the brake 35 make a rotation by passage of bag 1. Their drive means are thus controlled specifically as this rhythm must be adapted to the length of the bags 1 at the interval separating them.

The overlapped bags 1 are placed against the first transfer means 31 by the roller 34, the first bag 1*a* passing under the roller 34 after having been braked by the brake 35. They then arrive at the nose 36.

Figure 7:
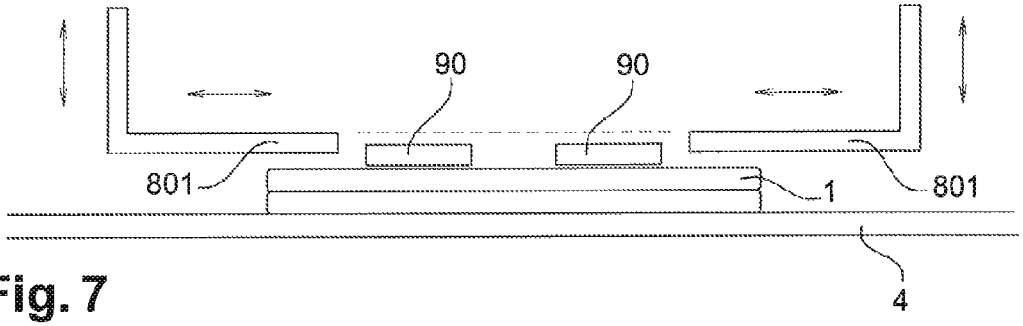
FIGS. 7 to 11 are schematic cross-sectional views through line VII-VII of FIG. 6 according to various steps in the method according to the invention.

In reference to FIGS. 5 and 7, the bags 1 are stacked on the receiving table 4, the fingers 801 of the separating device 80 being in retraction position, above the bags 1. The bags 1, which arrive, slide onto the top of the stack of bags 1 which forms. The abutment 5 stops the bags 1 when they come into contact with the abutment face 50, whilst the upper transport means 9 accompany the bags 1 still overlapped towards the abutment 5. During this accumulation phase, the receiving table 4 descends gradually to maintain the upper level of the stack of bags 1 at a constant level and thus maintain the overlapped bags 1 in contact with the upper transport means 9.

Figure 8:
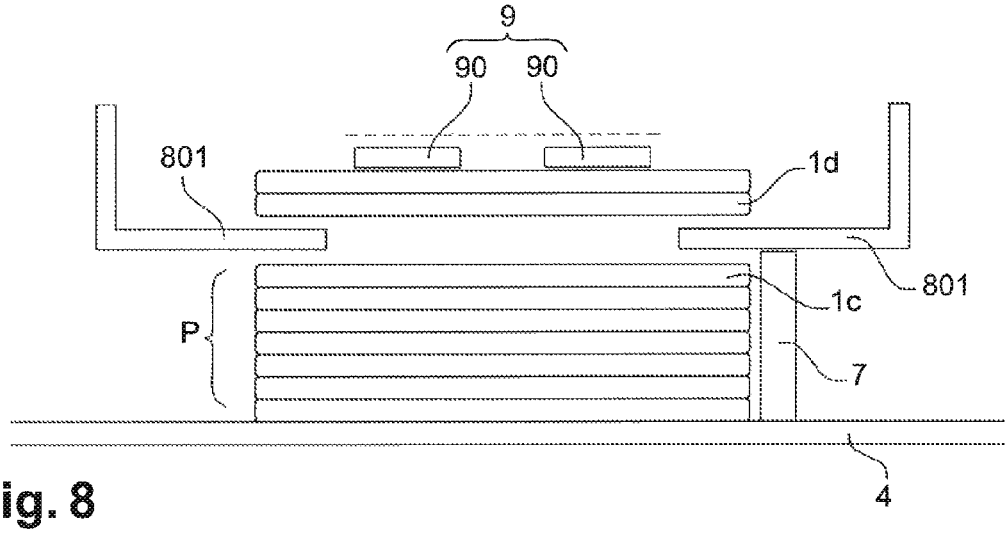

When a pack P with a predetermined number of bags 1 is on the receiving table 4, the separating device 80 is driven in a separating direction F4 perpendicular to the plane of the bags 1 towards a separating position up to a first level so that the fingers 801 are inserted between a preceding bag 1*c* and a following bag 1*d* as shown on FIG. 8. The preceding bag 1*c* and the following bag 1*d* continue their advance movement until the preceding bag 1*c* is in abutment.

Figure 9:
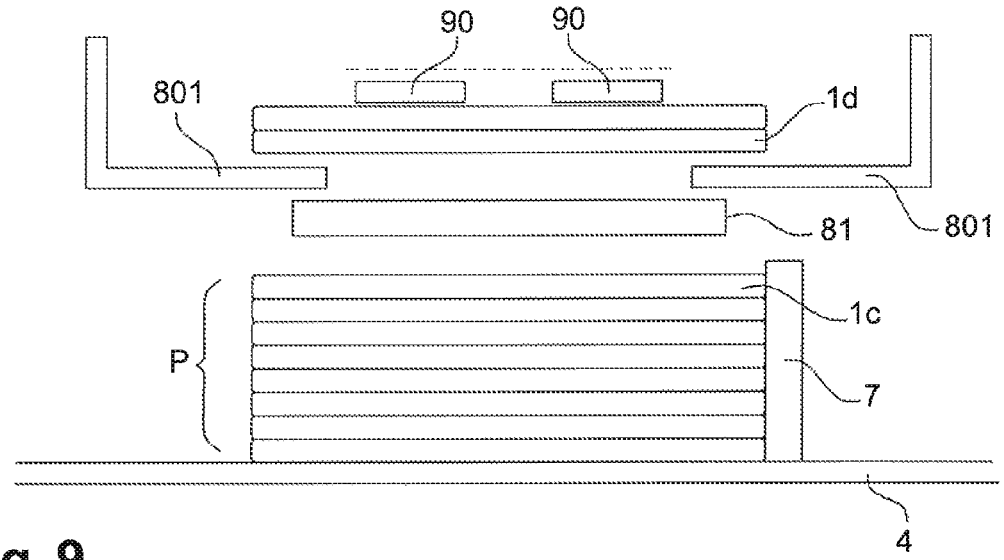

Then, the separating device 80 is moved to a second level passing the flexible blade 82 which retracts then returns to its position maintaining the rear edge 12*d* of the following bag 1*d*, to separate the following bag 1*d* and the preceding bag 1*c* at the rear edges 12*c*, 12*d*. The rear edges 12 of the bags 1 in the pack P on the receiving table 4 are slightly compressed downwards. The separating table 81 is then inserted in the oriented direction of advance F3 into the open space between the preceding bag 1*c* and the following bag d as shown on FIGS. 6 and 9. The following bag 1*d* is then supported by the separating table 81. The fingers 801 of the separating device 80 are driven so that they move away in a transverse direction and disengage from the bags 1, as shown on FIG. 10, the separating device 80 is moved upwards up to the retraction position and the fingers 801 return to the initial position, which comprises, with the downward movement to the second level, a square cycle movement. The position reached is shown on FIG. 11.

Figure 10:
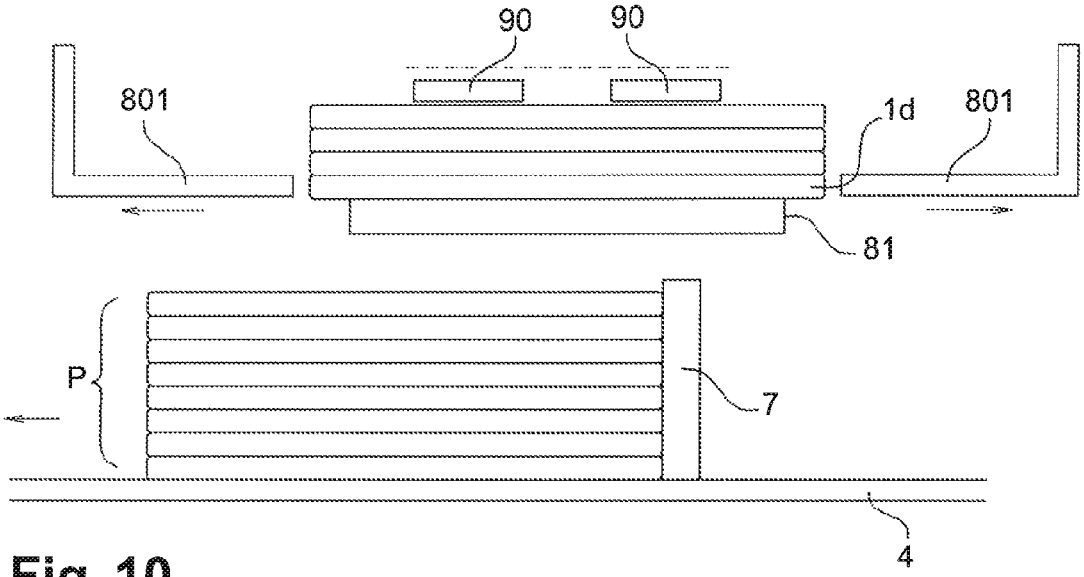
Figure 11:
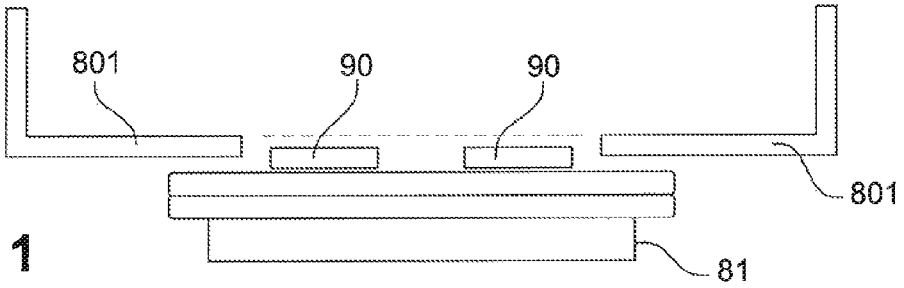

At the same time, the receiving table 4 is moved downwards to transfer the pack P of bags 1 to the transfer table 6 and the pack P of bags 1 is evacuated by means of the ejection grid 7, as shown on FIG. 10. When the ejection grid 7 returns to its place, the receiving table 4 is moved upwards and the separating table 81 is retracted to transfer the following bag 1*d* to the receiving table 4. A new pack forming cycle starts.

Figure 12:
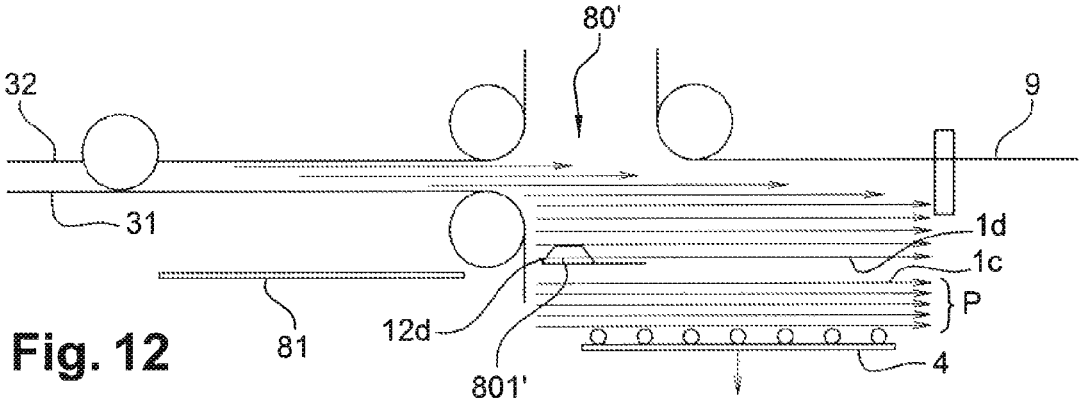
FIG. 12 is a view similar to FIG. 6 for a second embodiment of the invention.

The second embodiment of the invention, shown schematically on FIG. 12, is different from the first embodiment by the fact that the machine does not include flexible blades. Preferentially, the fingers 801' of the separating device 80' extend over a longer length in the advance direction.

In operation, after the device has reached the first level, the following bag 1*d* is moved away from the preceding bag 1*c* by lowering the receiving table 4, the separating device 80' supporting the rear edge 12*d* at least of the following bag 1*d*. The separating table 81 is then inserted under the following bag 1*d*. At this time, the situation is the same as in the first embodiment and the operation continues in the same manner.

Figure 13:
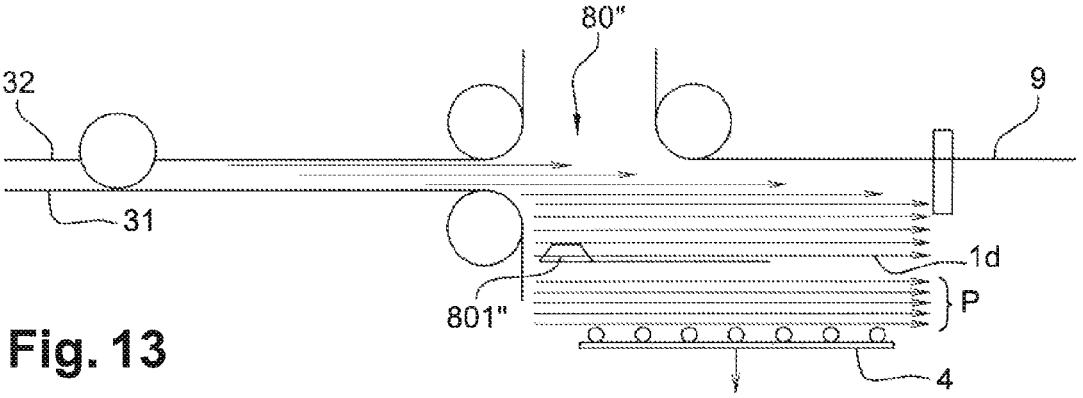
FIG. 13 is a view similar to FIG. 6 for a third embodiment of the invention.

The third embodiment, shown schematically on FIG. 13, is different from the first embodiment by the fact that the machine includes no flexible blades or separating table. Moreover, the fingers 801" of the separating device 80" extend over a length corresponding practically to the length of the bag.

In operation, after the first level has been reached by the separating device 80", the fingers 801" support the following bag 1*d* essentially over the complete length of the bag. The position of the separating device 80" is continually adjusted to maintain the upper level of the stack of bags 1 on the following bag 1*d* at a constant level.

The receiving table 4 can then be lowered to transfer the pack of bags 1 onto the transfer table 6. Once the pack P has been evacuated, the receiving table 4 is moved upwards under the following bag 1*d* then the fingers 801" of the separating device 80" are retracted to transfer the following bag 1*d* and the bags 1 above the latter onto the receiving table 4.

The invention claimed is:

1. A method for forming packs of flat bags wherein a continuous line of bags moving in a horizontal oriented direction of advance is received, comprising:

converting the continuous line of bags into a line of overlapped bags before stacking them, movingly contacting the overlapped bags, over a receiving table on which the bags are stacked, while the bags are stopped in the oriented direction of advance by an abutment to form a stack, lowering the receiving table;

separating the bags that are located above the receiving table and disposed in generally the same vertical plane as the stacked bags on the receiving table by a separator comprising a separating device, wherein when a pack with a predetermined number of bags is on the receiving table, the separating device is moved in a vertical separating direction perpendicular to the horizontal oriented direction of advance to receive a following bag in the overlapped line such that the separating device is placed between the following bag and a preceding bag, and such that when the following bag stops against the abutment, it is at least partially supported by the separator.

2. The method according to claim 1, wherein the following bag is separated from the preceding bag at least at the level of a rear edge of the bags and, the separator includes a separating table that is inserted in an oriented direction of advance between the preceding bag and the following bag to support the following bag.

3. The method according to claim 2, wherein the separating device is vertically moved in the separating direction to a first level during which the separating device maintains conditions allowing the preceding bag to reach the abutment, then the separating device is vertically moved to a second level maintaining the rear edge of the following bag by a flexible blade protruding in the oriented direction of advance to separate the following bag and the preceding bag at the rear edges.

4. The method according to claim 2, wherein the following bag is separated from the preceding bag by lowering the receiving table, the separating device supporting the rear edge of at least the following bag.

5. The method according to claim 2, wherein, after the insertion of the separating table, the process continues by retracting the separating device.

6. The method according to claim 1, wherein the following bag is supported by the separating device essentially over the complete length of the bag, and the receiving table is lowered, the separating device supporting the following bag.

7. The method according to claim 1, wherein a position of the separating device is continually adjusted to maintain an upper level of the stack of bags on the following bag at a constant level.

8. The method according to claim 1, wherein the position of the receiving table is continuously adjusted to maintain the upper level of the stack of bags at a constant level.

9. The method according to claim 1, wherein the upper level of the stack is maintained against an upper transporter placed above the receiving table and accompanying the bags arriving on the stack in the oriented direction of advance up to the abutment.

10. The method according to claim 1, wherein the receiving table is lowered after the following bag is supported, the pack of bags supported by the receiving table is evacuated, the receiving table is moved up and the separator is retracted to transfer the following bag to the receiving table.

11. The method according to claim 1, wherein the separating device is moved according to a square cycle in a plane perpendicular to the oriented direction of advance, one of the movements of the square cycle being the insertion of the separating device.

12. The method according to claim 1, wherein a first transfer device moves at a speed lower than the arrival speed of the bags at a distance from each other, a press down member upstream of the first transfer device moves the rear edge of a first bag in a press down direction perpendicular to the plane of the bags until a second bag which follows the first bag covers the rear edge of the first bag.

13. The method according to claim 12, wherein a brake near and downstream of the press down member places the first bag against the first transfer device near the rear edge of the first bag.

14. The method according to claim 13, wherein the overlapped bags are placed against the first transfer device by a roller, the bag passing under the roller after having been braked by the brake.

15. The method according to claim 12, wherein each bag comprises a flap not glued but folded to be pressed down on a first face of the bag, the bags being placed so that they reach the first transfer device with the flap reaching the first transfer device first and the first face oriented in the press down direction.

16. A machine for forming packs of bags receiving a continuous line of bags moving in a horizontal oriented direction of advance according to the method of claim 1, comprising:

a receiving table on which the bags are stacked and stopped by an abutment, a brake to receive the continuous line of bags and to form a line of overlapped bags on a first transfer device, a separator that receives the line of overlapped bags from the first transfer device and that comprises a separating device that moves in a vertical separating direction perpendicular to the horizontal oriented direction of advance to receive a following bag in the overlapped line such that the separating device is placed between the following bag and a preceding bag in a separation position such that, when the following bag stops against the abutment, it is supported by the separating separator.

17. The machine according to claim 16 further comprising a turnover device to carry out the method according to claim

15, the turnover device comprising a pair of turnover belts delimiting between them a trajectory describing approximately a U-turn.

* * * * *